US010240735B1

(12) United States Patent
Huang

(10) Patent No.: US 10,240,735 B1
(45) Date of Patent: Mar. 26, 2019

(54) ARTIFICIAL CANDLE LAMP

(71) Applicant: Dongguan Shengbang Electronic Techology Co., Ltd., Dongguan, Guangdong (CN)

(72) Inventor: Jinhu Huang, Dongguan (CN)

(73) Assignee: Dongguan Shengbang Electronic Technology Co., Ltd., Dongguan, Guangdong (CN)

( * ) Notice: Subject to any disclaimer, the term of this patent is extended or adjusted under 35 U.S.C. 154(b) by 0 days.

(21) Appl. No.: 15/957,715

(22) Filed: Apr. 19, 2018

(30) Foreign Application Priority Data

Feb. 10, 2018 (CN) ..... 2018 2 0251022 U
Apr. 12, 2018 (CN) ..... 2018 2 0538986 U

(51) Int. Cl.

| | |
|---|---|
| ***F21S 6/00*** | (2006.01) |
| ***F21S 9/02*** | (2006.01) |
| ***F21V 3/02*** | (2006.01) |
| ***F21S 10/04*** | (2006.01) |
| ***F21V 17/06*** | (2006.01) |
| *F21W 121/00* | (2006.01) |
| *F21Y 115/10* | (2016.01) |

(52) U.S. Cl.
CPC ..... *F21S 10/04* (2013.01); *F21S 6/001* (2013.01); *F21S 9/02* (2013.01); *F21V 3/02* (2013.01); *F21V 17/06* (2013.01); *F21W 2121/00* (2013.01); *F21Y 2115/10* (2016.08)

(58) Field of Classification Search
CPC ... F21S 10/04; F21S 6/001; F21S 9/02; F21V 3/02; F21V 17/06
See application file for complete search history.

(56) References Cited

U.S. PATENT DOCUMENTS

| | | | | |
|---|---|---|---|---|
| 5,664,879 | A * | 9/1997 | Lai | F21S 6/001 362/249.01 |
| 2016/0290579 | A1* | 10/2016 | Au | F21S 10/046 |
| 2017/0356604 | A1* | 12/2017 | Huang | F21S 6/001 |

* cited by examiner

*Primary Examiner* — Thomas M Sember
(74) *Attorney, Agent, or Firm* — Muncy, Geissler, Olds & Lowe, P.C.

(57) ABSTRACT

The disclosure provides an artificial candle lamp, including a candle body provided with a candlewick through hole, a power source, and a shell provided in the candle body and located below the candlewick through hole, and further including a candlewick sheet, an elastic vibration device, a driving device, and a first light source provided in the shell; one end of the candlewick sheet is a free end and is exposed from the candlewick through hole, and the other end thereof is a connecting end extending into the shell; the connecting end is connected to the elastic vibration device; the elastic vibration device is fixed in the shell; the driving device is powered by the power source and drives the elastic vibration device to displace the candlewick sheet; the first light source is provided in the shell, and the light thereof is projected to the free end of the candlewick sheet. The artificial candle lamp of the disclosure is environment-friendly and safe, and can closely imitate combustion dynamics of a candle flame.

8 Claims, 4 Drawing Sheets

ARTIFICIAL CANDLE LAMP

TECHNICAL FIELD

The disclosure relates to the technical field of electronic candles, and in particular, to an artificial candle lamp.

RELATED ART

The artificial candle lamp can imitate the candlelight effect of a flame candle, can effectively avoid fire hazard and is safe in use. Therefore, the flame candle is replaced with the artificial candle lamp in numerous applications.

Simulation design is generally carried out on two parts of the candle lamp, i.e., a candleholder and a lampwick. The simulation design of the candleholder is simple and mature. However, the design of the lampwick is still in a state of lower simulation degree so far. At present, the similarity between structure principles of the artificial candle lamps on the market is: making the lampwick into a candlewick sheet, setting the middle of the candlewick sheet as a structure capable of freely moving around a support, then providing a magnet at the bottom of the candlewick sheet, and providing an electromagnet to produce a varying magnetic field to drive the magnet to repel amplitude variation so as to drive the candlewick sheet to waggle, thereby simulating the effect that the lampwick freely swings with the wind.

However, the lampwick simulation structure similar to said artificial candle lamp still has many defects, for example, first, said artificial candle lamp can only simulate the effect that the lampwick freely swings with the wind, but cannot simulate the effect that candle flame burns and flickers in a windless condition; secondly, because it is simulated that the candle flame freely swings with the wind, the swinging amplitude and direction of the candlewick sheet of said artificial candle lamp are random and uncontrollable, more space needs to be reserved to adapt to overlarge swinging amplitude of the candlewick sheet, and the swinging condition of the candle flame in breeze cannot be simulated; thirdly, in an artificial candle lamp driven by an electromagnet, because the electromagnet would produce the repulsive force for driving the candlewick sheet of said artificial candle lamp to waggle, continuous power supply is required and the power consumption is high; moreover, because the artificial candle lamp is generally powered by a battery, and the duration of power supply of the battery is limited, the replacement frequency of battery is high, and this goes against with environment protection; and finally, the candleholder of said artificial candle lamp is entirely opaque, and the simulation degree is still low.

SUMMARY

The disclosure provides an environment-friendly and safe artificial candle lamp capable of closely imitating combustion dynamics of a candle flame.

To solve said technical problem, the disclosure adopts the following technical solution:

Provided is an artificial candle lamp, comprising a candle body provided with a candlewick through hole, a power source, and a shell provided in the candle body and located below the candlewick through hole, and further comprising a candlewick sheet, an elastic vibration device, a driving device, and a first light source provided in the shell;

one end of the candlewick sheet is a free end and is exposed from the candlewick through hole, and the other end thereof is a connecting end extending into the shell; the connecting end is connected to the elastic vibration device;

the elastic vibration device is fixed in the shell;

the driving device is powered by the power source and drives the elastic vibration device to displace the candlewick sheet;

the first light source is provided in the shell, and the light thereof is projected to the free end of the candlewick sheet.

Furthermore, the elastic vibration device comprises a magnetic element, an elastic element, and a pedestal; the magnetic element is fixedly provided at the connecting end of the candlewick sheet; one end of the elastic element is connected to the connecting end of the candlewick sheet, and the other end thereof is connected to the pedestal; the pedestal is snapped into the shell;

the driving device comprises an electromagnetic coil and a PCBA board electrically connected to the power source, the PCBA board provides driving current to the electromagnetic coil, the elastic element moves along an axis direction of the electromagnetic coil under the action of the electromagnetic coil, and the candlewick sheet displaces under the combined action of the magnetic element and the elastic element.

Preferably, the connecting end of the candlewick sheet is provided with an accommodating cavity connected to the candlewick sheet body and a hollow cylinder connected to the accommodating cavity, the magnetic element is provided in the accommodating cavity, and the hollow cylinder is closely fit and fixed with the elastic element.

Optionally, the elastic element is a spring; the pedestal comprises a base sheet and a convex column; the convex column is fixedly provided on the base sheet, and the external diameter of the convex column is smaller than that of the base sheet; the elastic element is sleeved on the convex column, and the base sheet is snapped into the shell.

Preferably, a snap-in portion downwardly extends from the bottom of the shell, two parallel convex ribs are provided on an inner wall of the snap-in portion, a slot is formed between the two convex ribs, and the base sheet is snapped into the slot.

As an improvement, a second light source is further provided in the candle body, and the second light source is powered by the power source.

Preferably, the candle body is a semitransparent candle body, and the second light source is provided below the external bottom of the shell.

Preferably, the candlewick sheet is a silicone sheet or a rubber sheet.

Optionally, the power source is a dry cell or a rechargeable battery.

Compared with the prior art, because the candlewick sheet of the artificial candle lamp of the disclosure is connected to the elastic vibration device, and the candlewick sheet displaces by a certain distance due to the elasticity of the elastic vibration device while the elastic vibration device is driven by the driving device to displace and swing; in the process of reciprocating deformation-restoration of an elastic structure in the elastic vibration device, the candlewick sheet can displace by a short distance in each direction, i.e., up, down, left, and right, within the swinging range while swinging; that is, the artificial candle lamp can simulate the effect that the lampwick of the candle swings with the wind and can simulate the effect that candle flame burns and flickers in a windless condition by only adjusting the power of the driving device, and therefore is environment-friendly and safe, and can also closely imitate combustion dynamics of the candle flame.

DETAILED DESCRIPTION

The disclosure is further described below in combination with the detailed description. The accompanying drawings are merely used for exemplary description, merely represent schematic diagrams rather than diagrams of real products, and cannot be understood as limitations to the present patent. To better describe the embodiments of the utility mode, some components in the accompanying drawings would be omitted, zoomed or zoomed out, and do not represent the actual product sizes. Those skilled in the art could understand that some known structures and descriptions thereof in the accompanying drawings may be omitted.

Figure 1:
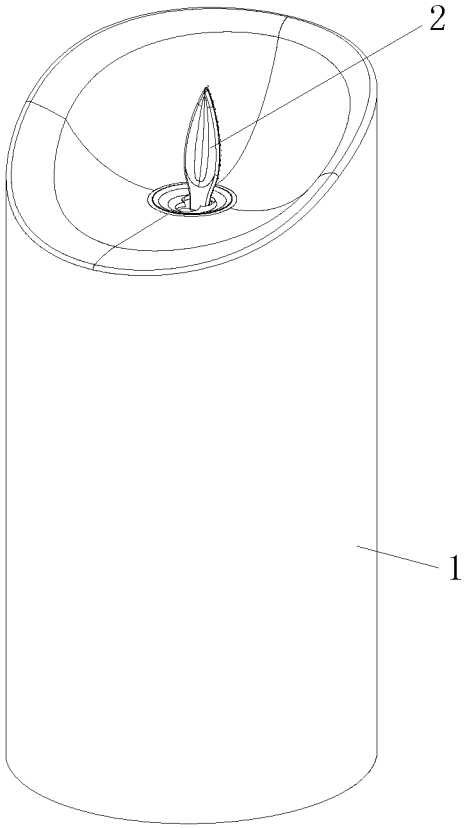
FIG. 1 is a stereogram of the artificial candle lamp of the disclosure.
Figure 2:
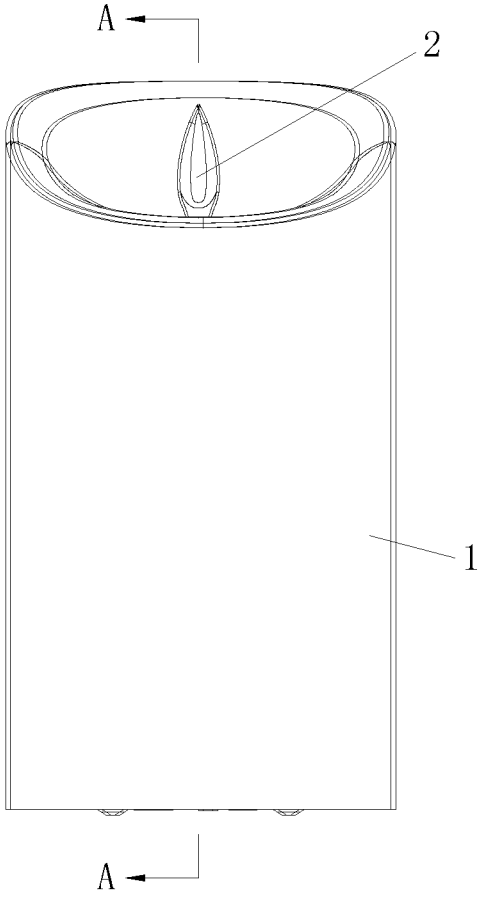
FIG. 2 is a front view of the artificial candle lamp of the disclosure.
Figure 3:
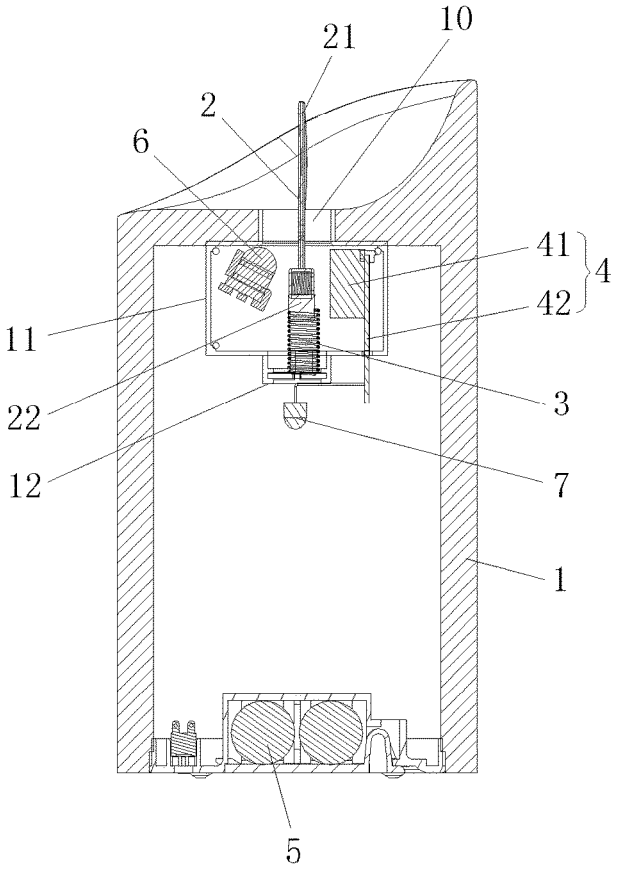
FIG. 3 is a schematic diagram of cross section A-A of FIG. 2.

FIGS. 1 to 6 illustrate embodiments of the artificial candle lamp of the disclosure. As illustrated in FIGS. 1, 2, and 3, the artificial candle lamp comprises a candle body 1, a candlewick sheet 2, an elastic vibration device 3, a driving device 4, and a power source 5, and is a realistically simulated candle; an upper end of the candle body 1 is made into a burned candle surface, i.e., a cambered surface, and a candlewick through hole 10 is provided at the middle of the cambered candle surface; a shell 11 is further provided in the candle body 1 and is located below the candlewick through hole 10; and a first light source 6 is provided in the shell 11.

One end of the candlewick sheet 2 is a free end 21 and is exposed from the candlewick through hole 10, and the other end thereof is a connecting end 22 extending into the shell 11; the connecting end 22 is connected to the elastic vibration device 3; the light of the first light source 6 is projected to the free end 21 of the candlewick sheet 2; and the elastic vibration device 3 is fixed in the shell 11. To facilitate structure design and installation, the driving device 4 is also fixed in the shell 11 and is powered by the power source 5, and the driving device 4 drives the elastic vibration device 3 to displace the candlewick sheet 2.

Because the candlewick sheet 2 of the artificial candle lamp in embodiments of the disclosure is connected to the elastic vibration device 3, and the candlewick sheet 2 displaces by a certain distance due to the elasticity of the elastic vibration device 3 while the elastic vibration device 3 is driven by the driving device 4 to displace and swing; in the process of reciprocating deformation-restoration of an elastic structure in the elastic vibration device, the candlewick sheet 2 can displace by a short distance in each direction, i.e., up, down, left, and right, within the swinging range while swinging; that is, the artificial candle lamp can simulate the effect that the lampwick of the candle swings with the wind and can simulate the effect that candle flame burns and flickers in a windless condition by only adjusting the power of the driving device 4, and therefore is environment-friendly and safe, and can also closely imitate combustion dynamics of the candle flame.

Figure 4:
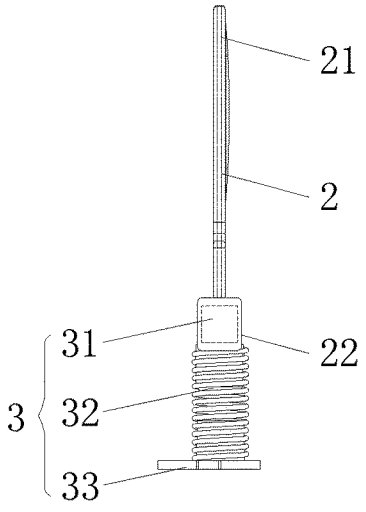
FIG. 4 is a schematic diagram of connection between a candlewick sheet and an elastic vibration device of the artificial candle lamp of the disclosure.
Figure 5:
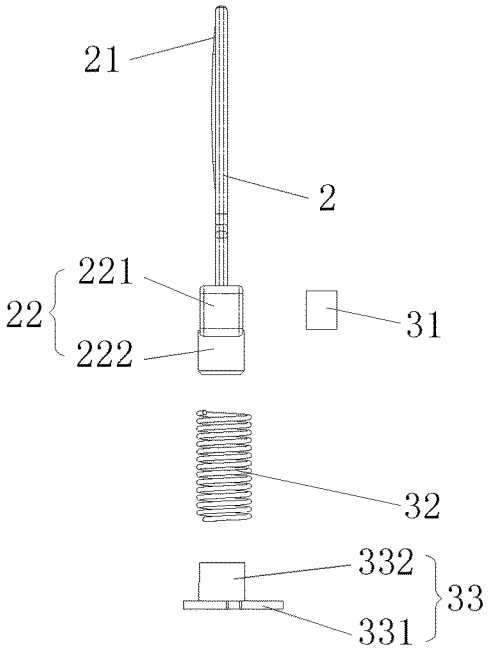
FIG. 5 is a structural exploded view of FIG. 4.

As illustrated in FIGS. 4 and 5, the elastic vibration device 3 of the artificial candle lamp of the present embodiment comprises a magnetic element 31, an elastic element 32, and a pedestal 33; the magnetic element 31 is fixedly provided at the connecting end 22 of the candlewick sheet 2; one end of the elastic element 32 is connected to the connecting end 22 of the candlewick sheet 2, and the other end thereof is connected to the pedestal 33; the pedestal 33 is snapped into the shell 11; as illustrated in FIG. 3, the driving device 4 comprises an electromagnetic coil 41 and a PCBA board 42 electrically connected to the power source 5; the PCBA board 42 provides driving current to the electromagnetic coil 41; the elastic element 32 moves along an axis direction of the electromagnetic coil 41 under the action of the electromagnetic coil 41; the candlewick sheet 22 displaces under the combined action of the magnetic element 31 and the elastic element 32.

The magnetic element 31 is provided in a direction such that the magnetic element 31 can move along the axis direction of the electromagnetic coil 41, i.e., producing varying current by the PCBA board 42 so that the electromagnetic coil 41 produces a varying magnetic field. Because the magnetic field of a permanent magnet (i.e., the magnetic element 31) provided at the connecting end 22 of the candlewick sheet 2 is fixed, the repulsive or attractive force produced by the magnetic element 31 would change with the size of the magnetic field of the electromagnetic coil 41, so that the swinging amplitude of the candlewick sheet 2 in the same direction as the magnetic element 31 changes accordingly. That is, the winging frequency and amplitude of the candlewick sheet 2 can be controlled and adjusted through adjusting the magnitude of current of the PCBA board 42.

The magnetic element 31 of the present embodiment adopts a permanent magnet, and the elastic element 32 adopts a spring. Therefore, the practicality is high, the materials are easy to be obtained, and low in cost. Furthermore, the present embodiment can adopt a 7*5*4 mm magnet which can provide a larger magnetic field. However, the electromagnetic coil 41 can achieve operation of a product by only providing a smaller magnetic field (the working current is small), thereby achieving low energy consumption.

Specifically, when the electromagnetic coil 41 produces a magnetic field through current, N-pole of the magnetic field and N-pole of the magnetic element 31 on the connecting end 22 of the candlewick sheet 2 produce a magnetic field cutting line to produce the repulsive force; S-pole of the magnetic field and the N-pole of the magnetic element 31 on the connecting end 22 of the candlewick sheet 2 produce a magnetic field cutting line to produce the attractive force, so as to drive the candlewick sheet 2 to move along the axis direction of the electromagnetic coil 41. Because the elastic element 32 is deformed by thrust force, the back-forth swinging force produced by deformation of the elastic element 32 makes the free end 21 of the candlewick sheet 2 swing within a large range, and meanwhile, the candlewick sheet 2 swings within a smaller range in each direction under the action of the spring. That is, the candlewick sheet 2 displaces under the combined action of the magnetic element 31 and the elastic element 32, the connecting end 22 of the candlewick sheet 2 swings back and forth in a certain frequency, and the free end 21 would swing within a larger range than the connecting end 22 due to no restriction. Under the projection of the light of the first light source 6, a soft glow effect would occur to the edge of the swinging candlewick sheet 2; moreover, the swinging amplitude of the top of the free end 21 is maximum, the swinging path thereof is a circular arc, and therefore, the glow effect is more significant.

In addition, the light of the first light source 6 of the artificial candle lamp in the present embodiment is projected to the free end 21 of the candlewick sheet 2, specifically, a highlight focus spot area to which the light of the first light source 6 is projected is located at the center of the candlewick sheet 2; as the candlewick sheet 2 swings, the focus spot swings up and down by coordinating with the edge glow, and therefore, the simulation degree is extremely high. It is difficult to distinguish true flame from false flame even in close observation.

As an improvement of said embodiment, to facilitate installation of the magnetic element 31 and connection between the candlewick sheet 2 and the elastic element 32, as illustrated in FIG. 5, the connecting end 22 of the candlewick sheet 2 is configured as an accommodating cavity 221 connected to the candlewick sheet body and a hollow cylinder 222 connected to the accommodating cavity 221, wherein the magnetic element 31 is provided in the accommodating cavity 221, and the hollow cylinder 222 is closely fit and fixed with the elastic element 32, i.e., the hollow cylinder 222 is directly inserted in the spring to facilitate installing or detaching.

As a further improvement of said embodiment, as illustrated in FIG. 5, the pedestal 33 comprises a base sheet 331 and a convex column 332; the elastic element 32 is sleeved on the convex column 332, the convex column 332 is fixedly provided on the base sheet 332, and the external diameter of the convex column 332 is smaller than that of the base sheet 331 so as to ensure the sleeve stability of the elastic element 32; and the base sheet 331 is snapped into the shell 11 to facilitate installing. It should be noted that, to ensure the swinging displacement and connection of the candlewick sheet 2, the length of the spring should be at least greater than the total length of the hollow cylinder 222 and the convex column 332.

Figure 6:
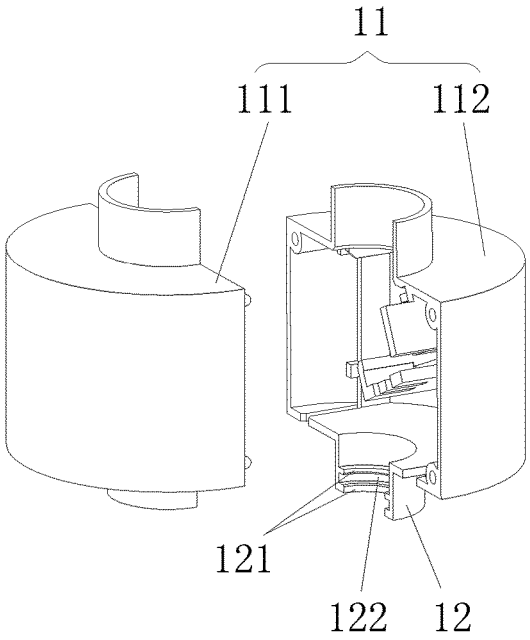
FIG. 6 is a schematic structural diagram of a shell of the artificial candle lamp of the disclosure.

In addition, as illustrated in FIGS. 3 and 6, a snap-in portion 12 downwardly extends from the bottom of the shell 11, two parallel convex ribs 121 are provided on an inner wall of the snap-in portion 12, a slot 122 is formed between the two convex ribs 121, and the base sheet 331 is snapped into the slot 122. On one hand, the installation of the pedestal 33 is facilitated, and on the other hand, a space is reserved over the convex ribs 121 of the snap-in portion 12 to ensure a deformation space for the elastic element 32, thereby ensuring a displacement space for the candlewick sheet 2, without reserving more space to adapt to large swinging of the candlewick sheet 2.

In practical use, to facilitate manufacturing, installing and replacing parts such as the light source, as illustrated in FIG. 6, the shell 11 is generally made into a left shell 111 and a right shell 112, and during installation of the pedestal 33 of the elastic vibration device 3, the base sheet 331 is inserted in the slot 122 of the left shell 111/right shell 112, then the other shell is installed, and meanwhile is aligned to the corresponding slot 122 to complete the installation.

As an improvement of said embodiment, as illustrated in FIG. 3, a second light source 7 is further provided in the candle body 1, and the second light source 7 is powered by the power source 5; the candle body 1 is a semitransparent candle body, and the second light source 7 is provided below the external bottom of the shell 11. In practical installation design, the second light source 7 can not only be directly powered by the power source 5, but also be connected to the PCBA board 42 and powered thereby to facilitate line lapping or control operations. That is, the design can provide light projection to the candle body 1 downwardly so that the candle body 1 is transparent to increase the overall simulation degree. Moreover, because the candle body 1 is transparent, it can also serve as a night lamp, so that the practicability of the artificial candle lamp is improved.

In embodiments of the disclosure, light sources such as the first light source 6 and the second light source 7 are generally replaced by LEDs, which are more energy-saving and have long service life, thereby reducing the manufacturing cost of the artificial candle lamp.

In addition, to further improve the simulation degree of the artificial candle lamp, in the embodiments of the disclosure, the candlewick sheet 2 may be a silicone sheet or a rubber sheet. Moreover, the free end 21, i.e., the upper end, of the candlewick sheet 2 may be manufactured as candle flame to increase the sense of reality.

In the embodiments of the disclosure, the power source 5 may be a dry cell or a rechargeable battery, which has long service life and is recyclable, thereby reducing the replacement frequency of the battery and contributing to environmental protection.

Obviously, said embodiments of the disclosure are merely used for clearly describing examples of the disclosure, rather than limiting embodiments of the disclosure. On the basis of said description, those skilled in the art can also make other different types of changes or variations. It is neither necessary nor possible to describe all embodiments. Any modifications, equivalent substitutions and improvements made within the spirit and principle of the disclosure should be included within the scopes of protection of the claims of the disclosure.

What is claimed is:

1. An artificial candle lamp, comprising a candle body provided with a candlewick through hole, a power source, and a shell provided in the candle body and located below the candlewick through hole, and further comprising a candlewick sheet, an elastic vibration device, a driving device, and a first light source provided in the shell;

one end of the candlewick sheet is a free end and is exposed from the candlewick through hole, and the other end thereof is a connecting end extending into the shell; the connecting end is connected to the elastic vibration device;

the elastic vibration device is fixed in the shell;

the driving device is powered by the power source and drives the elastic vibration device to displace the candlewick sheet;

the first light source is provided in the shell, and the light thereof is projected to the free end of the candlewick sheet, wherein the elastic vibration device comprises a magnetic element, an elastic element, and a pedestal; the magnetic element is fixedly provided at the connecting end of the candlewick sheet; one end of the elastic element is connected to the connecting end of the candlewick sheet, and the other end thereof is connected to the pedestal; the pedestal is snapped into the shell;

the driving device comprises an electromagnetic coil and a PCBA board electrically connected to the power source: the PCBA board provides driving current to the electromagnetic coil; the elastic element moves along an axis direction of the electromagnetic coil under the action of the electromagnetic coil; the candlewick sheet displaces under the combined action of the magnetic element and the elastic element.

2. The artificial candle lamp according to claim 1, wherein the connecting end of the candlewick sheet is provided with an accommodating cavity connected to the candlewick sheet body and a hollow cylinder connected to the accommodating cavity, the magnetic element is provided in the accommodating cavity, and the hollow cylinder is closely fit and fixed with the elastic element.

3. The artificial candle lamp according to claim 1, wherein the elastic element is a spring; the pedestal comprises a base sheet and a convex column; the convex column is fixedly provided on the base sheet, and the external diameter of the convex column is smaller than that of the base sheet; the elastic element is sleeved on the convex column, and the base sheet is snapped into the shell.

4. The artificial candle lamp according to claim 3, wherein a snap-in portion downwardly extends from the bottom of the shell, two parallel convex ribs are provided on an inner wall of the snap-in portion, a slot is formed between the two convex ribs, and the base sheet is snapped into the slot.

5. The artificial candle lamp according to claim 1, wherein a second light source is further provided in the candle body, and the second light source is powered by the power source.

6. The artificial candle lamp according to claim 5, wherein the candle body is a semitransparent candle body, and the second light source is provided below the external bottom of the shell.

7. The artificial candle lamp according to claim 1, wherein the candlewick sheet is a silicone sheet or a rubber sheet.

8. The artificial candle lamp according to claim 7, wherein the power source is a dry cell or a rechargeable battery.

* * * * *